US006066041A

United States Patent [19]

Hernandez et al.

[11] Patent Number: 6,066,041

[45] Date of Patent: May 23, 2000

[54] AIR FILTER INLET AND POSITIONING GUIDE FOR AN AIR CONDITIONER

[75] Inventors: Nestor Hernandez, Mirador Residencial Monterrey; David Hernandez, Nuevo Leon, both of Mexico

[73] Assignee: Carrier Corporation, Syracuse, N.Y.

[21] Appl. No.: 09/140,462

[22] Filed: Aug. 26, 1998

[51] Int. Cl.[7] ..... E06B 7/02

[52] U.S. Cl. ..... 454/201; 62/262

[58] Field of Search ..... 62/262; 454/201; 55/359, 354, 493

[56] References Cited

U.S. PATENT DOCUMENTS

| | | | |
|---|---|---|---|
| 4,210,071 | 7/1980 | Loos | 98/94 |
| 4,743,281 | 5/1988 | Kennedy | 55/493 |
| 5,379,609 | 1/1995 | Matsumoto | 62/262 |
| 5,679,121 | 10/1997 | Kim | 55/481 |

*Primary Examiner*—Henry Bennett
*Assistant Examiner*—Melvin Jones

[57] ABSTRACT

An air conditioner is provided of the type having an indoor section, which includes a housing, evaporator coil and an indoor grille adapted to be mounted to the housing in spaced relation to the evaporator coil. The grille includes a front wall having a return opening therein to admit return air to be conditioned into the evaporator coil. The front wall also has an elongated opening adjacent to an edge thereof, which is adapted to receive a filter for insertion and removal of the filter into the space between the back wall of the indoor grille and the evaporator coil. The filter includes a rectangular frame having a leading edge and a trailing edge and laterally spaced edges interconnecting the leading and trailing edges. A filter guide structure is integrally formed with the grille and is adapted to receive the leading edge of the filter with the filter frame angularly disposed with respect to the front wall and for directing the rectangular frame into the space between the back wall of the indoor grille and the evaporator coil without contacting the evaporator coil. In a preferred embodiment, the trailing edge defines an ornamental outer wall similar in configuration to the structure defining the return air openings in the front wall of the grille. Structure is provided on the ornamental outer wall and the filter guide structure for supporting and positioning the outer wall with respect to the outer grille structure.

4 Claims, 5 Drawing Sheets

AIR FILTER INLET AND POSITIONING GUIDE FOR AN AIR CONDITIONER

BACKGROUND OF THE INVENTION

The present invention relates to air conditioners and, more particularly, to an arrangement for facilitating the installation of a filter in the indoor grille of a room air conditioner.

Room air conditioners typically have an indoor section and an outdoor section. The indoor section is responsible for cooling and dehumidifying the interior of a room while the outdoor section is responsible for exhausting heat into the outdoor environment. The indoor and outdoor sections each have a heat exchanger coil and a fan, and each has a return air opening and a discharge opening. A grille structure is normally installed over each section to prevent the entry of foreign objects, while allowing the free-flow of air to and from the sections as well as for aesthetic considerations.

It is common practice to have associated with the indoor grille structure a filter element, through which the indoor air passing to the indoor coil must pass. Such a filter is designed to remove substantially smaller contaminants from the air than the indoor grille. Quite often the indoor grille must be removed from the air conditioner in order to gain access to the filter. Other air conditioners are known which have a rectangularly shaped reusable filter, which slides into a slot oriented above the grille such that the filter may be installed or withdrawn from a location behind the grille and in front of the evaporator coil by vertically displacing the filter within the slot.

It is also known to provide a filter assembly, which is provided with moveable guides which receive the filter and prevent the filter assembly from contacting and possibly damaging the fragile heat exchange fins of the evaporator coil as the filter is installed and removed from its mounting in an indoor grille.

It is deemed desirable to have a structure which is formed integrally with the indoor grille which facilitates easy insertion and removal of the indoor grille and which provides positioning and support of the filter assembly in a spaced relationship with the evaporator coil.

SUMMARY OF THE INVENTION

An air conditioner is provided of the type having an indoor section, which includes a housing, evaporator coil and an indoor grille adapted to be mounted to the housing in spaced relation to the evaporator coil. The grille includes a front wall having a return opening therein to admit return air to be conditioned into the evaporator coil. The front wall also has an elongated opening adjacent to an edge thereof, which is adapted to receive a filter for insertion and removal of the filter into the space between the back wall of the indoor grille and the evaporator coil. The filter includes a rectangular frame having a leading edge and a trailing edge and laterally spaced edges interconnecting the leading and trailing edges. A filter guide structure is integrally formed with the grille and is adapted to receive the leading edge of the filter with the filter frame angularly disposed with respect to the front wall and for directing the rectangular frame into the space between the back wall of the indoor grille and the evaporator coil without contacting the evaporator coil. In a preferred embodiment, the trailing edge defines an ornamental outer wall similar in configuration to the structure defining the return air openings in the front wall of the grille. Structure is provided on the ornamental outer wall and the filter guide structure for supporting and positioning the outer wall with respect to the outer grille structure.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
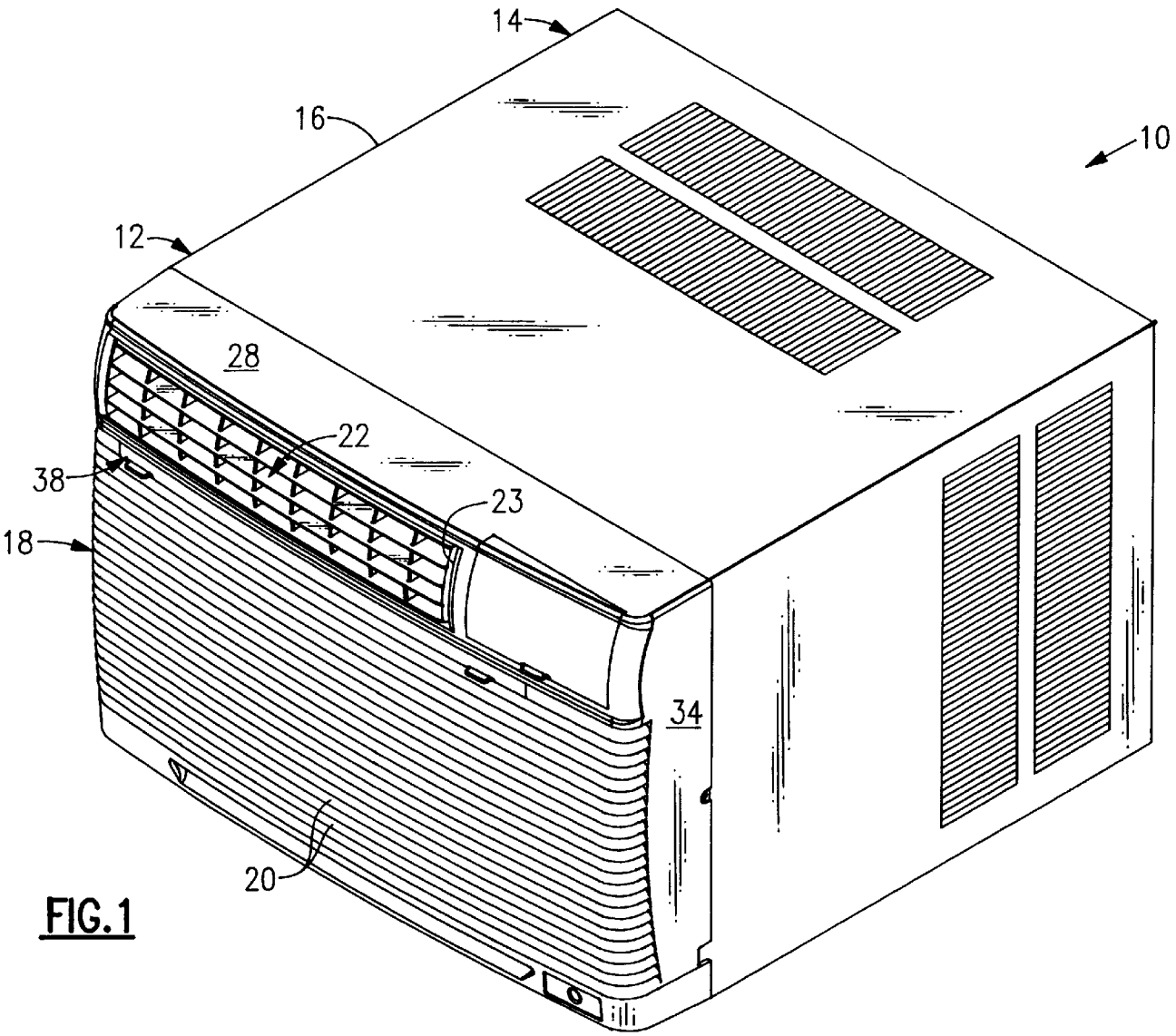
FIG. 1 is a perspective view of a room air conditioner which embodies the features of this invention.

FIG. 1 illustrates a room air conditioner unit 10 which includes generally an indoor section 12 and an outdoor section 14. The room air conditioner in enclosed is a substantially rectangular housing 16 and is adapted to be positioned in a rectangular opening in an exterior wall or in a window in a room where cooling is desired, with the indoor section 12 facing into the room, as is conventional.

The indoor section 12 includes an indoor grille section 18, which includes inlet louvers 20 and an air discharge assembly 22 mounted in an air discharge opening 23. During operation of the air conditioner, air from the space to be conditioned is drawn by action of an evaporator fan (not shown) through the inlet louvers 20 and is directed through an evaporator coil (shown schematically as 25 in FIGS. 4 and 5) where the air is cooled. The cooled air is then directed back into the room to be cooled through the air discharge opening 23 and air discharge assembly 22.

With reference now particularly to FIGS. 2–7, the indoor grille 18 comprises a molded plastic frame-like component 24 in which the inlet louvers 20 and the opening 23 for the air discharge assembly 22 are formed. The grille frame 24 comprises a substantially planar front section 26, a top wall 28, a bottom wall 30, and left and right-hand side walls 32 and 34, respectively. The top, bottom and side walls each extend rearwardly of the front section 26 and cooperate with one another to define a skirt-like configuration integrally formed with and extending rearwardly from the front wall 26. A horizontally extending opening 36 is provided in the planar front wall 26 at the upper end thereof, above the inlet louvers 20 and underlying the air discharge opening 23. As will be seen, the horizontal opening 36 is adapted to receive an air inlet filter assembly 38 therethrough.

Figure 2:
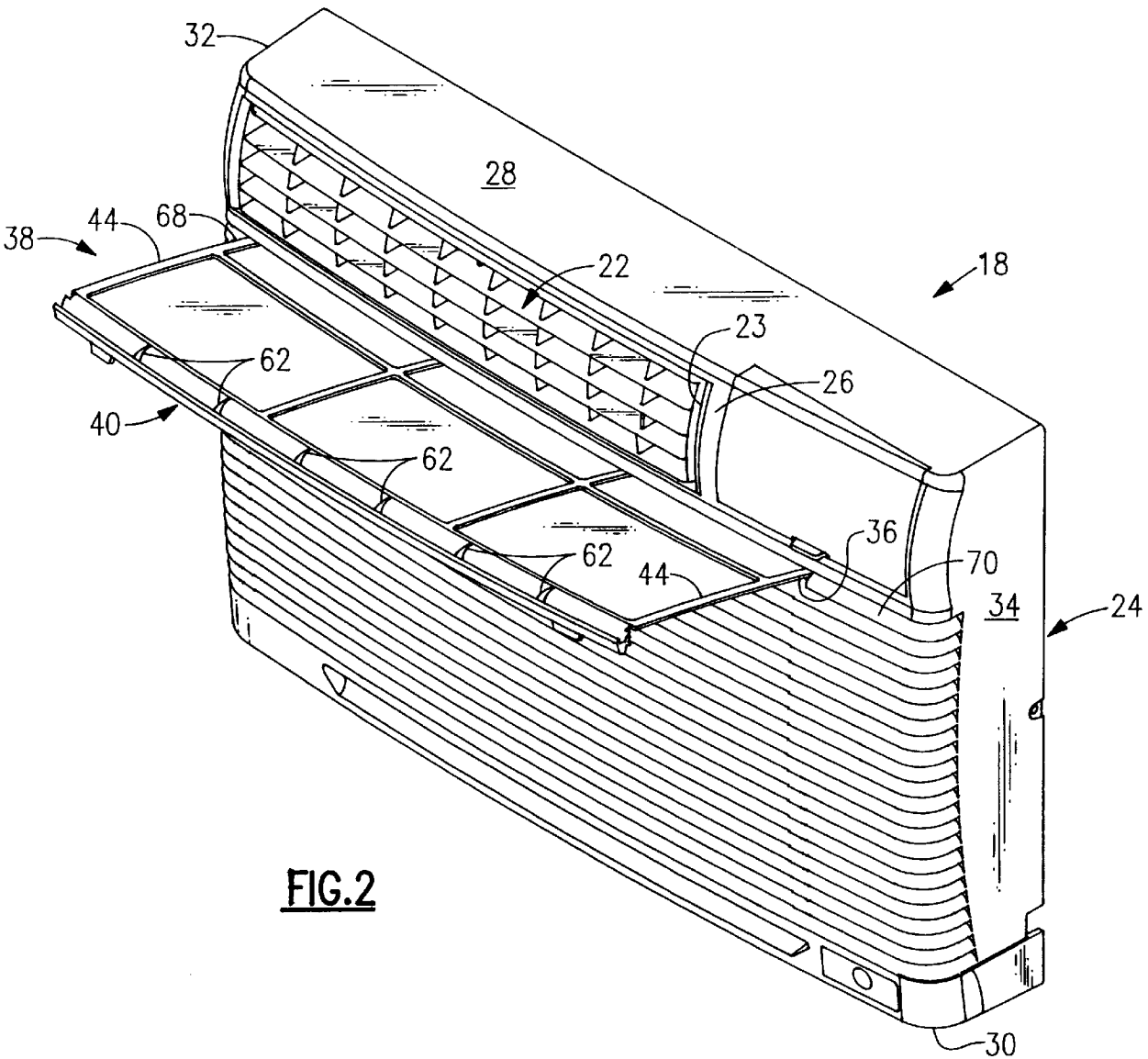
FIG. 2 is a perspective view of the front grille of the air conditioner of FIG. 1 with the inlet filter partially installed therein.
Figure 6:
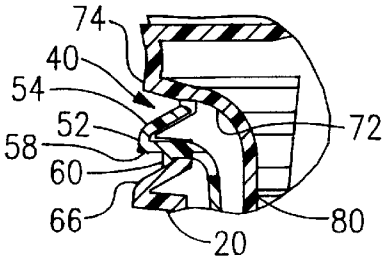
FIG. 6 is an enlarged view of the region identified as FIG. 6 in FIG. 4.
Figure 7:
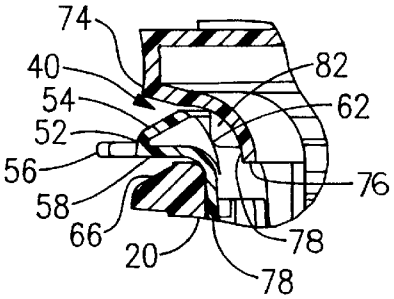
FIG. 7 is an enlarged view of the region identified as FIG. 7 in FIG. 5.
Figure 5:
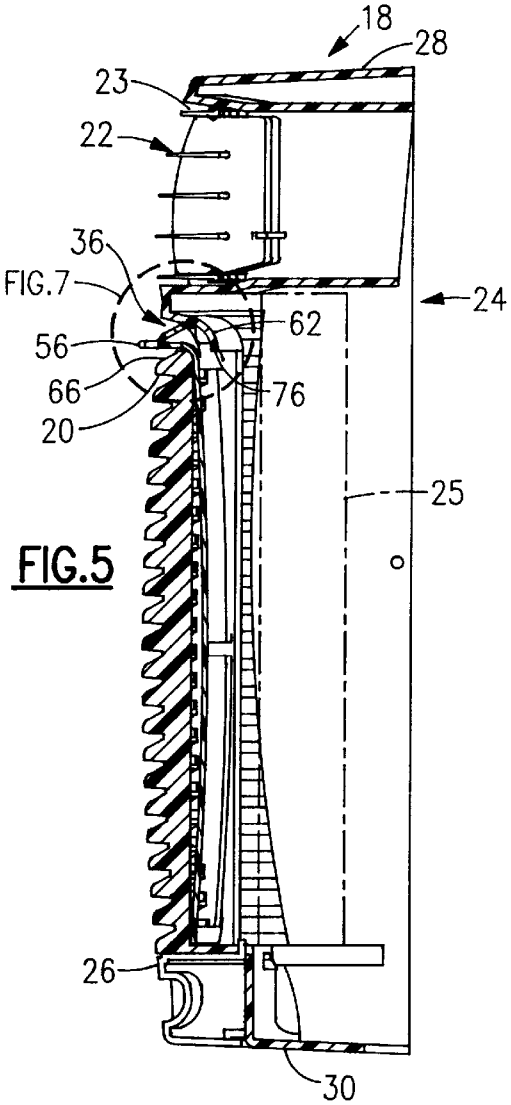
FIG. 5 is a view taken along the line 5—5 of FIG. 3.
Figure 4:
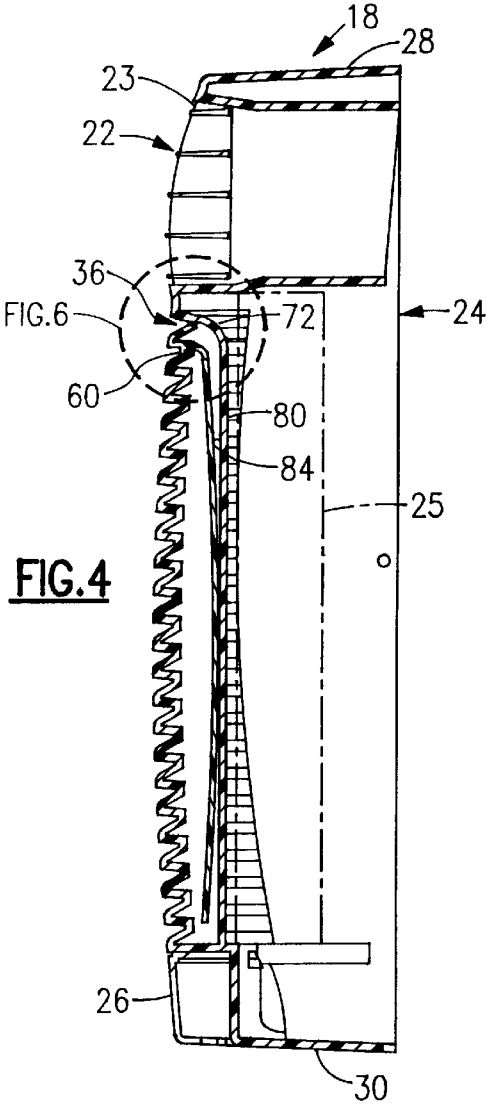
FIG. 4 is a view taken along the line 4—4 of FIG. 3.
Figure 9:
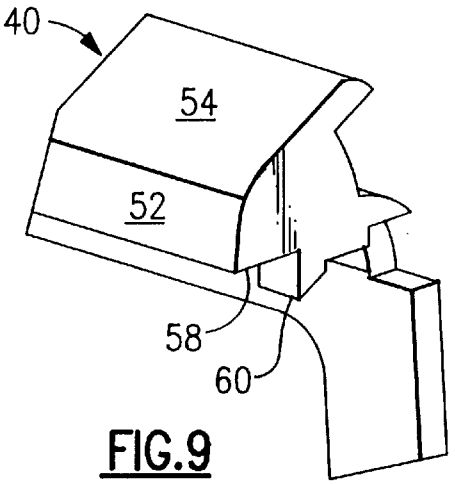
FIG. 9 is an enlarged view of the region identified as FIG. 9 in FIG. 8.
Figure 8:
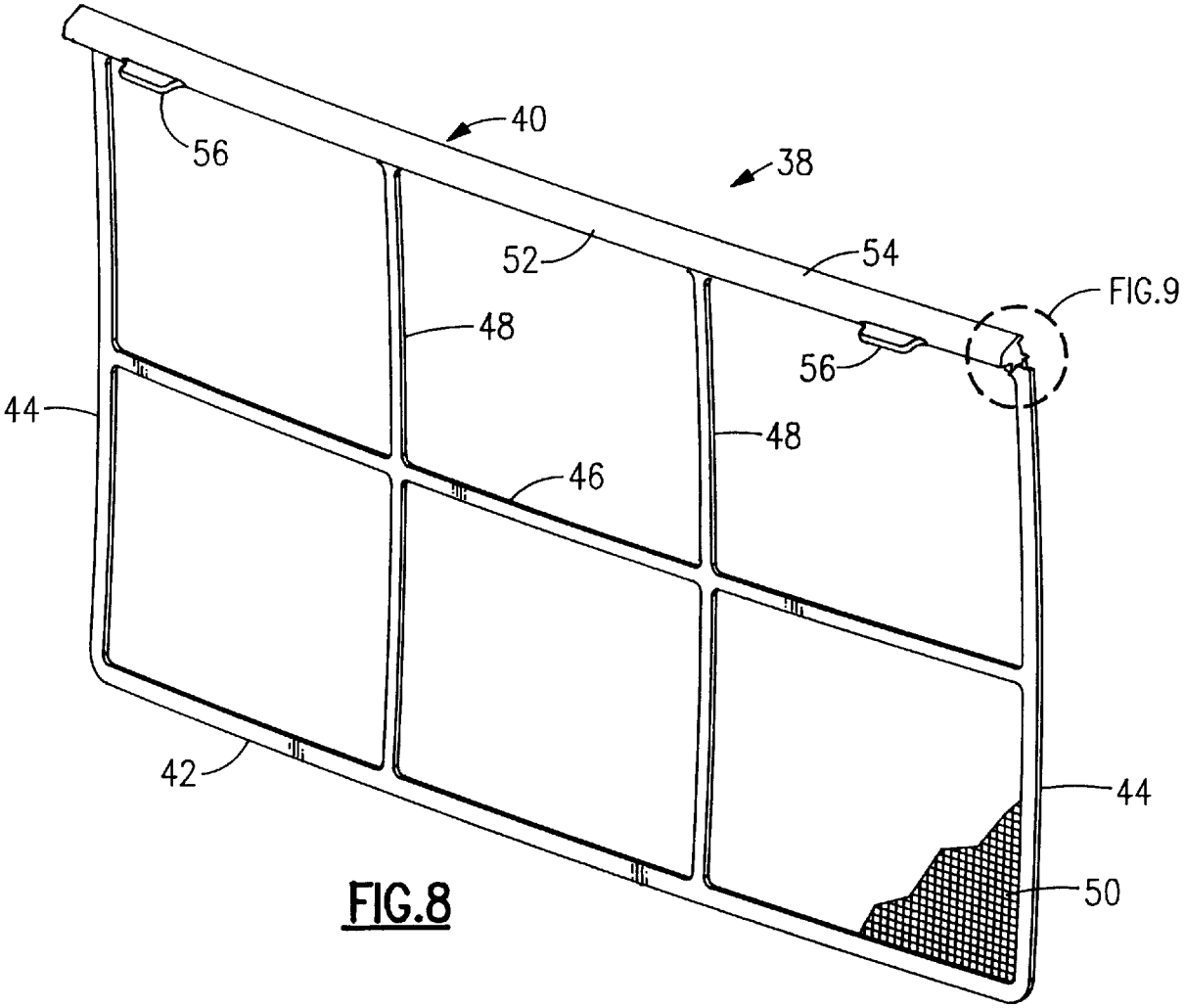
FIG. 8 is a perspective view of the inlet filter.

Looking now at FIGS. 8 and 9, the filter assembly 38 includes a substantially rectangular frame having an upper wall 40, a lower wall 42 and a pair of laterally spaced side walls 44. A horizontally extending member 46 extends between the side walls 44 and a pair of vertically extending members 48 extend between the top wall 40 and the bottom wall 42 to define a grid-like structure preferably made from an unfilled cropolymer polypropylene. A filter screen material 50 overlies and is integrally attached to the sections forming the filter assembly 38. This screen is preferably a polypropylene material and is adapted to be cleaned by vacuuming and/or washing so that it may be reused for the lifetime of the filter. The top wall 40 of the filter has a cross-sectional profile which presents a forwardly facing surface 52 and an inclined upwardly facing surface 54, which substantially match the profile of each of the inlet louvers 20, as seen in FIGS. 6 and 7. Extending forwardly at opposite ends of the forward facing surface 52 of the top wall 40 are a pair of tabs 56, which facilitate insertion and removal of the filter from the air conditioning unit. Extending downwardly from the lower surface 58 of the top wall 40 are a pair of positioning lugs 60, as best seen in FIGS. 4, 6 and 9. As best seen in FIGS. 2, 5 and 7, the back of the top wall 40 is substantially open and is provided with a series of six arcuately shaped elements 62, which present a curved surface facing rearwardly of the filter assembly 38.

Figure 3:
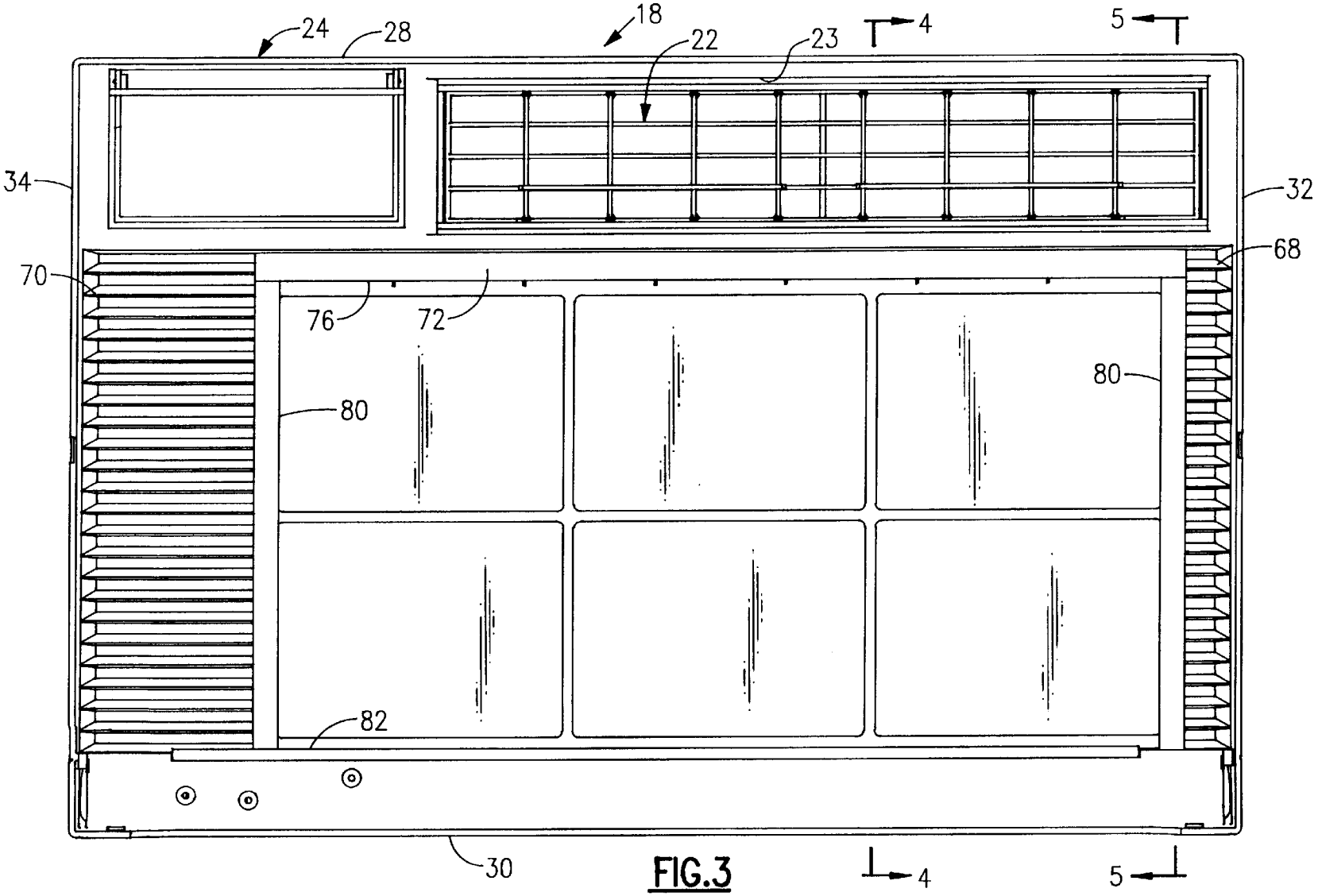
FIG. 3 is a rear view of the front grille of the air conditioner of FIG. 1 with a filter installed therein.

Looking now at FIGS. 3–7, the filter assembly receiving and guiding structure will be described in detail. First, it should be understood that FIG. 3 illustrates the back of the indoor grille 18. The references to left and right-hand sides are based on viewing the air conditioning unit and grille 18 from the front, as illustrated in FIG. 1 and, accordingly, references to left and right are reversed with respect to FIG. 3.

The horizontal opening 36 is defined at the bottom edge thereof by the top edge 66 of one of the horizontally extending inlet louvers 20. The opening 36 is bounded on the left and right-hand sides thereof by molded configurations 68 and 70, respectively, which have the appearance of an inlet louver 20. The top of the horizontal opening 36 is defined by a curved surface 72, which extends from a horizontal edge 74 on the front wall 26 of the grille frame 24 and which extends inwardly and downwardly where it terminates in a second horizontal edge 76 within the interior of the grille frame and spaced rearwardly from the back 78 of the inlet louvers 20 (shown best in FIG. 7). As best seen in FIGS. 3, 4 and 6, a pair of spaced apart vertically extending guide walls 80 extend from opposite ends of the second horizontal edge 76 where they terminate at a horizontal structural wall 82, which is located coincident with the lower most of the horizontal inlet louvers 20. The vertical walls 80 are spaced from the louvers by the same distance as the second horizontal edge 76 and together define a channel configured to receive the side walls 44 of the filter assembly therein when the filter is installed in the grille. As best seen in FIGS. 5 and 7, a pair of outwardly extending protrusions 82 are located in spaced relationship on the curved surface 72.

With the filter assembly structure and the grille guide structure, as so described, when a filter assembly 38 is inserted into the horizontal opening 36, the bottom wall 42 of the filter assembly which serves as a leading edge will pass through the opening 36 where it will engage the curved surface 72, which will be guide it inwardly and downwardly until the side walls 44 engage the inside surfaces 84 of the vertical walls 80. The walls 80 will then serve to guide the filter assembly vertically downwardly into a substantially parallel relationship with the indoor grille 18, as illustrated in FIGS. 3, 4 and 5.

Upon completion of the insertion of the filter assembly, the forward facing surface 52 and the inclined surface 54 of the top wall 40 of the filter assembly will be in the position illustrated in FIGS. 4–7 and will have the appearance of a continuation of an inlet louver 20. This appearance will be further reinforced by the left and right simulated louver structures 68 and 70, respectively, located on opposite sides of the horizontal opening 36.

The top wall 40 will be restrained in the desired position by engagement of the positioning lugs 60 carried on the lower surface 58 of the top wall 40 with the top surface 66 of the inlet louver 20, which underlies the horizontal opening 36, as best shown in FIGS. 4 and 6. Further, rearward movement of the top wall 40 is prevented by engagement of the arcuate surface of two of the arcuate elements 62 with the positioning protrusions 82 of the curved surface 72, as best shown in FIGS. 5 and 7.

What is claimed is:

1. An air conditioner of the type having an indoor section, which includes a housing having an evaporator coil mounted therein in a substantially vertical orientation, and an indoor grille adapted to be mounted to the housing in spaced relation to the evaporator coil, the grille including a front wall having a return air opening therein to admit return air to be conditioned into the evaporator coil, the front wall having an elongated opening therein adjacent to an edge thereof, the opening being adapted to facilitate insertion and removal of a filter into the space between the back wall of the indoor grille and the evaporator coil, the filter including a rectangular frame having a leading edge and a trailing edge, and laterally spaced edges interconnecting the leading and trailing edges, wherein the improvement comprises:

a filter guide structure integrally formed with said grille structure, for receiving said leading edge of said filter, following passage of said leading edge through said elongated openings with said filter frame angularly disposed with respect to said front wall and for directing said rectangular frame into parallel relationship with said front wall.

2. The apparatus of claim 1 wherein said filter guide structure comprises a longitudinally extending curved wall having a first end defining an upper edge of said elongated opening and extending rearwardly and downwardly into the space between the back wall of the indoor grille and the evaporator coil.

3. The apparatus of claim 2 comprising a pair of vertically extending guide walls extending at opposite ends of said elongated opening, each of said guide walls having an upper end which cooperates with one end of said curved surface to provide a continuous guide surface on opposite sides of said filter and a lower end which terminates and is integrally formed with a portion of said grille underlying said return air openings of said grille.

4. The apparatus of claim 3 wherein said return air openings are defined by a plurality of horizontally extending contoured louvers, and wherein said trailing edge of said filter comprises a horizontally extending element having the same ornamental configuration as one of said horizontally extending louvers.

* * * * *